US011129468B2

(12) United States Patent
Jung et al.

(10) Patent No.: US 11,129,468 B2
(45) Date of Patent: Sep. 28, 2021

(54) CLEANING DEVICE HAVING A HOOD WITH A SWEEPER AND AN AIR KNIFE

(71) Applicant: EncoreNetworks Co., Ltd., Ulsan (KR)

(72) Inventors: Hae Young Jung, Ulsan (KR); Sang Yong Jang, Ulsan (KR)

(73) Assignee: EncoreNetworks Co., Ltd., Ulsan (KR)

( * ) Notice: Subject to any disclaimer, the term of this patent is extended or adjusted under 35 U.S.C. 154(b) by 308 days.

(21) Appl. No.: 16/486,180

(22) PCT Filed: Jan. 25, 2018

(86) PCT No.: PCT/KR2018/001106
§ 371 (c)(1),
(2) Date: Aug. 15, 2019

(87) PCT Pub. No.: WO2018/151436
PCT Pub. Date: Aug. 23, 2018

(65) Prior Publication Data

US 2020/0237088 A1 Jul. 30, 2020

(30) Foreign Application Priority Data

Feb. 17, 2017 (KR) ..... 10-2017-0021834

(51) Int. Cl.
*A46B 13/00* (2006.01)
*A47L 9/08* (2006.01)
(Continued)

(52) U.S. Cl.
CPC ..... *A46B 13/02* (2013.01); *A46B 13/008* (2013.01); *A47L 9/0477* (2013.01); *A47L 9/0488* (2013.01);
(Continued)

(58) Field of Classification Search
CPC ... A46B 13/02; A46B 13/008; A46B 15/0081; A46B 2200/3033; A46B 15/0051;
(Continued)

(56) References Cited

U.S. PATENT DOCUMENTS 3,704,482 A * 12/1972 Brannon ..... A47L 9/00 15/348
6,237,188 B1 * 5/2001 Takemoto ..... A47L 5/14 15/346
(Continued)

FOREIGN PATENT DOCUMENTS

KR 20-1996-0033505 U 11/1996
KR 10-0241139 B1 2/2000
(Continued)

*Primary Examiner* — David Redding
(74) *Attorney, Agent, or Firm* — Bayramoglu Law Offices LLC

(57) ABSTRACT

A cleaning device including a covering hood having a lower surface facing a surface to be cleaned and an inlet on an upper surface thereof, through which contaminants are sucked; an air knife provided on a circumference of the covering hood and having an outlet for spraying high pressure air to the surface to be cleaned; a sweeper installed inside the covering hood and rotated by a driving motor to guide foreign objects swept away from the surface to be cleaned and contaminants floated by the high pressure air injection of the air knife to the inlet; a rotary member including a shaft passing through a circumferential surface of the covering hood and the air knife, and a rotary knob coupled to one end of the shaft to rotate the air knife to adjust an air spray angle.

6 Claims, 4 Drawing Sheets

(51) Int. Cl.

| | |
|---|---|
| ***B08B 1/04*** | (2006.01) |
| ***A46B 15/00*** | (2006.01) |
| ***B08B 1/00*** | (2006.01) |
| ***A46B 13/02*** | (2006.01) |
| ***A47L 9/04*** | (2006.01) |
| ***A47L 11/202*** | (2006.01) |
| ***A47L 11/40*** | (2006.01) |
| *A47L 9/06* | (2006.01) |

(52) U.S. Cl.
CPC ..... *A47L 9/0494* (2013.01); *A47L 9/08* (2013.01); *A47L 11/202* (2013.01); *A47L 11/4058* (2013.01); *B08B 1/04* (2013.01); *A46B 15/0081* (2013.01); *A46B 2200/3033* (2013.01); *A47L 9/06* (2013.01); *B08B 1/002* (2013.01)

(58) Field of Classification Search
CPC ..... A46B 15/0053; A46B 13/001; A46B 2200/3066; A47L 11/4058; A47L 9/08; A47L 11/202; A47L 9/0477; A47L 9/0494; A47L 9/0488; A47L 9/06; A47L 11/4044; A47L 11/4077; A47L 9/0613; B08B 1/04; B08B 1/002; B08B 5/02; B08B 15/04
See application file for complete search history.

(56) References Cited

U.S. PATENT DOCUMENTS

| | | | | |
|---|---|---|---|---|
| 7,213,663 | B2 | 5/2007 | Kim | |
| 2003/0131440 | A1* | 7/2003 | Illingworth | A47L 9/08 15/346 |
| 2014/0082865 | A1* | 3/2014 | Takayanagi | B08B 5/00 15/1.51 |
| 2016/0201278 | A1* | 7/2016 | Happonen | E01H 1/056 134/6 |

FOREIGN PATENT DOCUMENTS

| | | | |
|---|---|---|---|
| KR | 10-0768922 | B1 | 10/2007 |
| KR | 10-1012943 | B1 | 2/2011 |
| KR | 10-1558450 | B1 | 10/2015 |

* cited by examiner

CLEANING DEVICE HAVING A HOOD WITH A SWEEPER AND AN AIR KNIFE

CROSS REFERENCE TO THE RELATED APPLICATIONS

This application is the national phase entry of International Application No. PCT/KR2018/001106, filed on Jan. 25, 2018, which is based upon and claims priority to Korean Patent Application No. 10-2017-0021834, filed on Feb. 17, 2017, the entire contents of which are incorporated herein by reference.

TECHNICAL FIELD

The present invention relates to a cleaning device having a hood with a sweeper and an air knife that help the hood suck contaminants on or stuck to the floor and deliver the same to the contaminant purifier.

BACKGROUND

Cleaning devices for sucking contaminants such as gas, steam, mist, and dust are widely used in various fields. For example, a discharge system is provided in a work space where painting, soldering, smelting, or the like is performed, for discharging various kinds of contaminants generated during operation to the outside of the work space. Also, a building or tunnel is provided with a ventilation and exhaust system for ventilating and exhausting the inside of the building or the tunnel. In the kitchen or the smoking room, hoods are used to remove food odors and tobacco smoke. As a technology related to such a cleaning device, Korean Patent No. 1012943 discloses a suction device capable of cleaning indoor corners comprising: a main body with an inlet through which contaminants of a surface to be cleaned is sucked; a cleaning member provided on at least one side of the main body and moving contaminants in the corners of a room to the inlet side; and a caster for facilitating movement of the main body and that of a side brush including a holder member surrounding a portion of the cleaning member, wherein the caster is provided between a turning radius of the holder member and a turning radius of the cleaning member. That is, according to the prior art, a brush sweeps off the contaminants on the surface to be cleaned, then the inlet sucks in the contaminants swept away by the brush. However, the prior art has a problem that the contaminants on the surface to be cleaned cannot be swept by a brush depending on the roughness of the surface, but remain on the surface. The prior art has a further problem that the particulate and liquid materials contained in the contaminants of the surface to be cleaned are not sucked into the inlet, but remain on the surface.

SUMMARY

Technical Challenge

The present invention has been made to solve the above problems, so it aims to provide a cleaning device having a hood with a sweeper and an air knife that are useful to remove contaminants as well as particulate and liquid materials contained therein irrespective of the roughness of the surface to be cleaned.

Solution to Problem

A cleaning device having a hood with a sweeper and an air knife according to the embodiment 1 of the present invention comprises: a covering hood having a lower surface facing the surface to be cleaned and having an inlet on an upper surface thereof, through which contaminants are sucked; an air knife provided on the circumference of the covering hood and having an outlet for spraying high pressure air to the surface to be cleaned; and a sweeper installed inside the covering hood and rotated by a driving motor to guide foreign objects swept away from the surface to be cleaned and contaminants floated by high pressure air injection of the air knife to the inlet. The cleaning device further comprises a rotary member including: a shaft passing through a circumferential surface of the covering hood and an air knife; and a rotary knob coupled to one end of the shaft to manually rotate the air knife to adjust an air spray angle. The cleaning device further includes a protective plate mounted on a surface of the air knife facing the sweeper to prevent the contaminants from impacting the air knife. The cleaning device further comprises buffer members including: a buffer socket vertically penetratingly coupled to the buffer pad extending on the outer circumference of the covering hood and having a lower surface opened; a buffer pin inserted into a lower surface of the buffer socket; a buffer spring having opposite ends coupled respectively to an outer circumferential surface of the buffer socket and to an outer circumferential surface of the buffer pin; and a buffer ball coupled to a lower end of the buffer pin. The device further comprises support members including a support shaft hinged to the axis of the sweeper and extending vertically and a support pin coupled to the rear of the support shaft and fitted to an outer circumferential surface of the covering hood. A cleaning device having a hood with a sweeper and an air knife according to the embodiment 2 of the present invention comprises: a covering hood having a lower surface opened facing a surface to be cleaned and an inlet on an upper surface thereof, through which contaminants are sucked; a first sweeper installed at one side of the inside of the covering hood and rotated to guide foreign objects swept from the surface to be cleaned to the inlet; and a second sweeper installed on the other side of the covering hood and rotated in a direction different from that of the first sweeper to guide foreign objects swept from the surface to be cleaned to the inlet together with the first sweeper. The cleaning device further comprises rotary members including: a shaft provided on a circumferential surface of the covering hood and passing through an air knife having an outlet for spraying high pressure air to the surface to be cleaned, a circumference of the covering hood, and the air knife; and a rotary knob which is coupled to one end of the shaft and adjusts air injection angle by rotating the air knife manually. The cleaning device further includes a protective plate to be provided on an opposite surface of the air knife, facing the first sweeper and the second sweeper, so that the contaminants are prevented from impacting against the air knife. The cleaning device further comprises buffer members including: a buffer socket vertically and penetratingly coupled to a buffer pad extending on an outer circumferential surface of the covering hood and having a lower surface opened, a buffer pin inserted into a lower surface of the buffer socket, a buffer spring having opposite ends coupled to an outer circumferential surface of the buffer socket and an outer circumferential surface of the buffer pin, respectively; and buffer ball connected to a lower end of the buffer pin. The cleaning device further comprises support members including: a pair of support shafts which are extended in the vertical direction and hinged to the axes of the first and the second sweepers; and a pair of support pins which are respectively coupled to the rear of the pair of support shafts and fitted to the outer circumferential surface of the covering hood.

According to the embodiment 1 of the present invention, a cleaning device having a hood with a sweeper and an air knife can remove contaminants of the surface to be cleaned irrespective of the surface roughness and can easily remove particulate and liquid materials contained in the contaminants of the surface to be cleaned, by using an air knife to inject high-pressure air to the surface to be cleaned and allowing sweepers to guide the contaminants into the inlet while the contaminants are floating. In addition, according to the embodiment 2 of the present invention, a cleaning device having a hood with a sweeper and an air knife can remove contaminants on the surface to be cleaned irrespective of the surface roughness and can easily remove particulate and liquid materials contained in the contaminants, by making a first sweeper and a second sweeper, rotating in different directions simultaneously, sweep the surface to be cleaned and guide the contaminants to the inlet.

DESCRIPTION OF SYMBOLS

Figure 1:
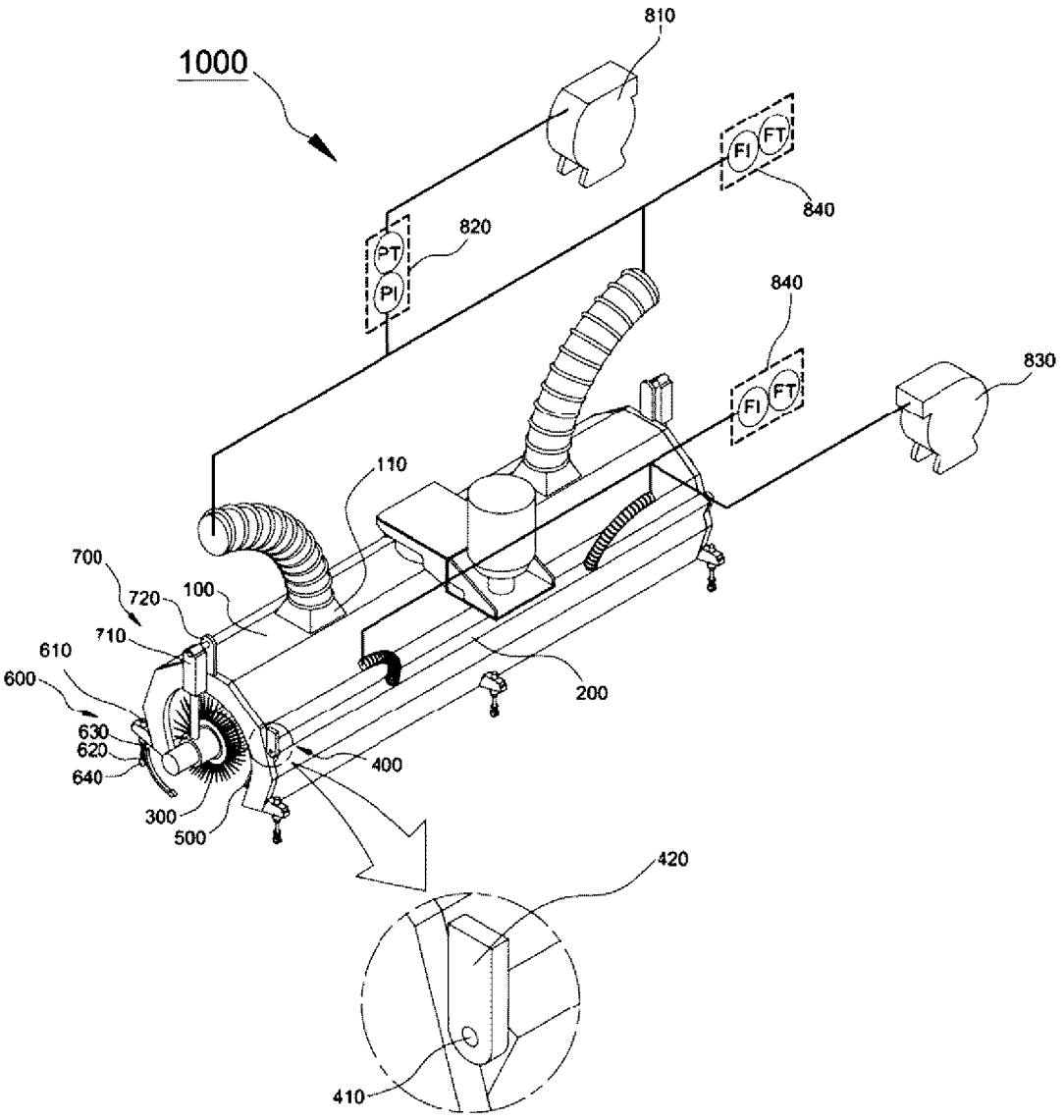
FIG. 1 is a perspective view showing a cleaning device having a hood equipped with a sweeper and an air knife according to Embodiment 1 of the present invention.

1000: A cleaning device having a hood with a sweeper and an air knife according to the present invention
100: covering hood
110: inlet
200: air knife
210: outlet
300: sweeper
300-1: a first sweeper
300-2: a second sweeper
400: rotary member
410: shaft
420: rotary knob
500: protective plate
600: buffer member
610: buffer socket
620: buffer pin
630: buffer spring
640: buffer ball
700: support member
710: support shaft
720: support pin
810: intake inverter
820: pressure gauge
830: supply inverter
840: flowmeter

DETAILED DESCRIPTION OF THE EMBODIMENTS

Hereinafter, the technical idea of the present invention will be described more specifically with reference to the accompanying drawings. The drawings, which are included to provide a further understanding of the technical concept of the present invention, are incorporated in and constitute a part of the specification, and are not intended to limit the scope of the present invention.

Embodiment 1

Figure 2:
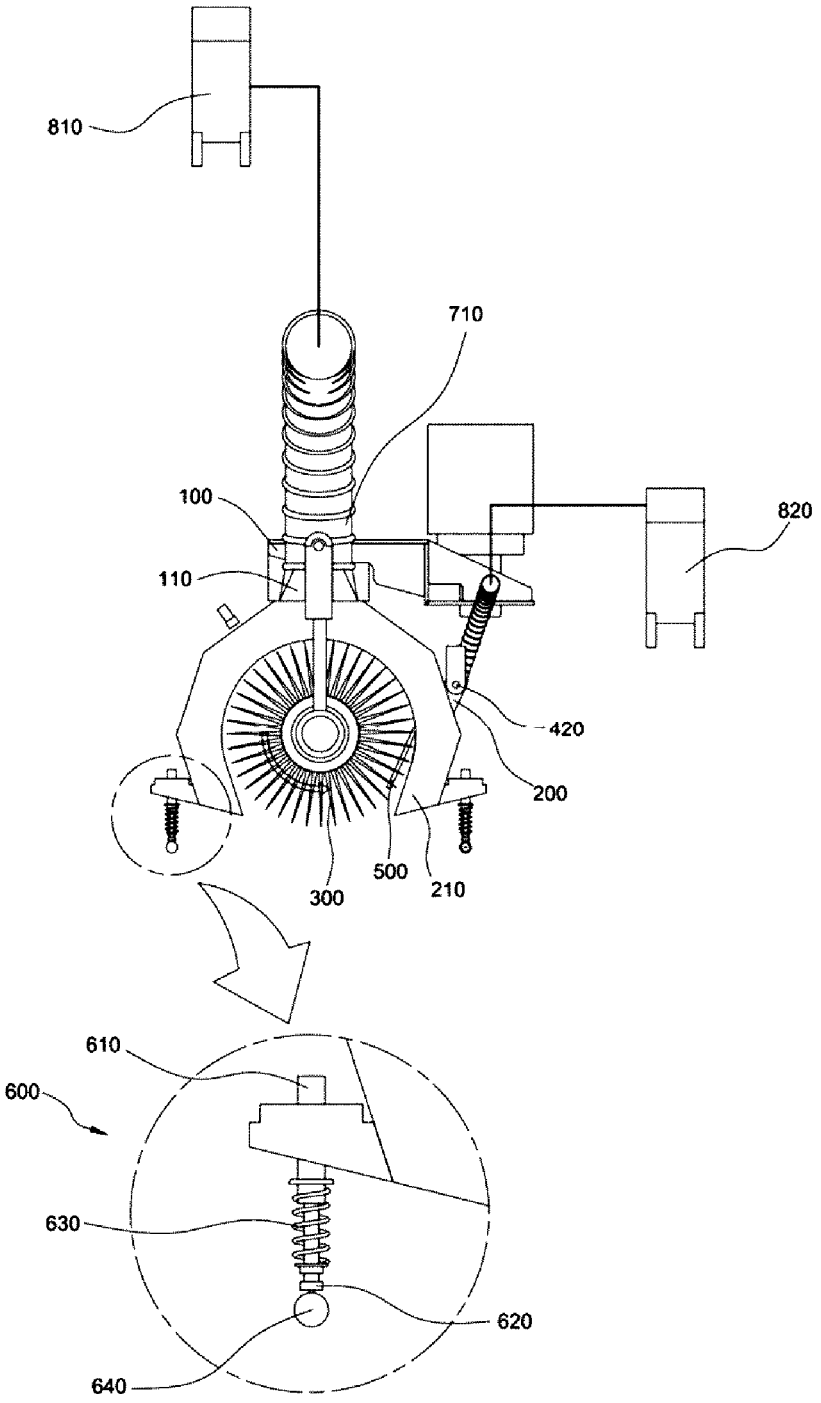
FIG. 2 is a front view showing a cleaning device having a hood equipped with a sweeper and an air knife according to Embodiment 1 of the present invention.

FIG. 1 is a perspective view showing a cleaning device having a hood with a sweeper and an air knife according to the embodiment 1 of the present invention. FIG. 2 is a front view showing a cleaning device having a hood with a sweeper and an air knife (1000) according to the embodiment 1 of the present invention. As illustrated in FIGS. 1 and 2, a cleaning device having a hood with a sweeper and an air knife (1000) according to the embodiment 1 of the present invention includes a covering hood (100), an air knife (200), and a sweeper (300). The covering hood (100), the main body of the present invention, may be formed in a hollow tube structure with a lower surface opened to face the surface to be cleaned, and has an inlet (110) through which contaminants are sucked. At this time, an intake inverter (810) for supplying a negative pressure to the inlet (110) and a pressure gauge (820) for measuring a negative pressure supplied to the inlet (110) from the intake inverter (810) may be further installed, and the pressure gauge (820) can be used to grasp the negative pressure of the inlet (110) and constantly adjust the air pressure supplied to the inlet (110) by the intake inverter (810). The air knife (200) is installed on the circumferential surface of the covering hood (100) and provided with an outlet (210), on a lower surface, for spraying high pressure air to the surface to be cleaned to float foreign objects on the surface. At this time, the outlet (210) may be formed in a horizontally long hole structure, but the present invention is not limited thereto. At this time, the air knife (200) may be further provided with a supply inverter (830) for supplying high-pressure air with its flow rate regulated and a flowmeter (840) for measuring the flow rate supplied to the air knife (200) from the supply inverter (830). The sweeper (300) is installed inside the covering hood (100) and rotated to guide foreign objects swept away from the surface to be cleaned and contaminants floated by high-pressure air injected by the air knife (200) to the inlet (110). Since the rotation of the sweeper (300) is performed by a normal driving motor (not shown), which is a well-known technique, detailed description thereof will be omitted. Conventional contaminant suction devices have had a problem that, depending on the surface roughness, contaminants could not be swept by a brush but remained on the surface to be cleaned, and particulate and liquid materials contained in the contaminants of the surface were not sucked but remained on the surface to be cleaned. A cleaning device having a hood with a sweeper and an air knife (1000) according to the embodiment 1 of the present invention, however, can remove contaminants of the surface to be cleaned irrespective of the surface roughness and can easily remove particulate and liquid materials contained in the contaminants of the surface to be cleaned, by using an air knife (200) to inject high-pressure air to the surface to be cleaned and allowing sweepers (300) to guide the contaminants into the inlet (110) while the contaminants are floating. In addition, the cleaning device having a hood with a sweeper and an air knife (1000) may further include a rotary member (400), a protective plate (500), a buffer member (600), and a support member (700). The rotary member (400), which rotates the air knife (200) to adjust the position of the air knife (200) that injects high-pressure air, includes a shaft (410) passing through the circumference of the covering hood (100) and the air knife (200) and a rotary knob (420) coupled to one end of the shaft (410) to manually rotate the air knife (200) to adjust an air spray angle. The protective plate (500) is installed on the air knife (200) to face the sweeper (300) so that contaminants floating on the surface to be cleaned are prevented from impacting against the air knife (200). At this time, the protective plate (500) is installed at a position where the protective plate (500) is in contact with the rotation radius of the sweeper (300), so that the contaminants sticking to a surface facing the sweeper (300) are swept away by the sweeper (300). The buffer member (600), which is to control the gap between the covering hood (100) and the surface to be cleaned, includes: a buffer socket (610) vertically and penetratingly coupled to a buffer pad extending on an outer circumferential surface of the covering hood (100) and having a lower surface opened; a buffer pin (620) inserted into the lower surface of the buffer socket 610); a buffer spring (630) having both ends connected to the outer circumferential surface of the buffer socket (610) and the outer circumferential surface of the buffer pin (620); and a buffer ball (640) coupled to the lower end of the buffer pin (620). The buffer ball (640), which is to adjust the elasticity of the buffer spring (630), adjusts the gap between the covering hood (100) and the surface to be cleaned so that the friction between the covering hood (100) and the surface to be cleaned can be minimized when the covering hood (100) is moving. The support member (700) includes: a support shaft (710) formed to be long in the vertical direction and hinged to the axis of the sweeper (300) that is simply fitted to the covering hood (100) for an easy replacement of the sweeper (300); and a support pin (720) coupled to the back of the support shaft (710) and fitted to an outer circumferential surface of the covering hood (100) at a lower surface thereof. Accordingly, it is possible to easily replace the sweeper (300) by simply releasing the fitting between the support member (700) and the covering hood (100).

Embodiment 2

Figure 3:
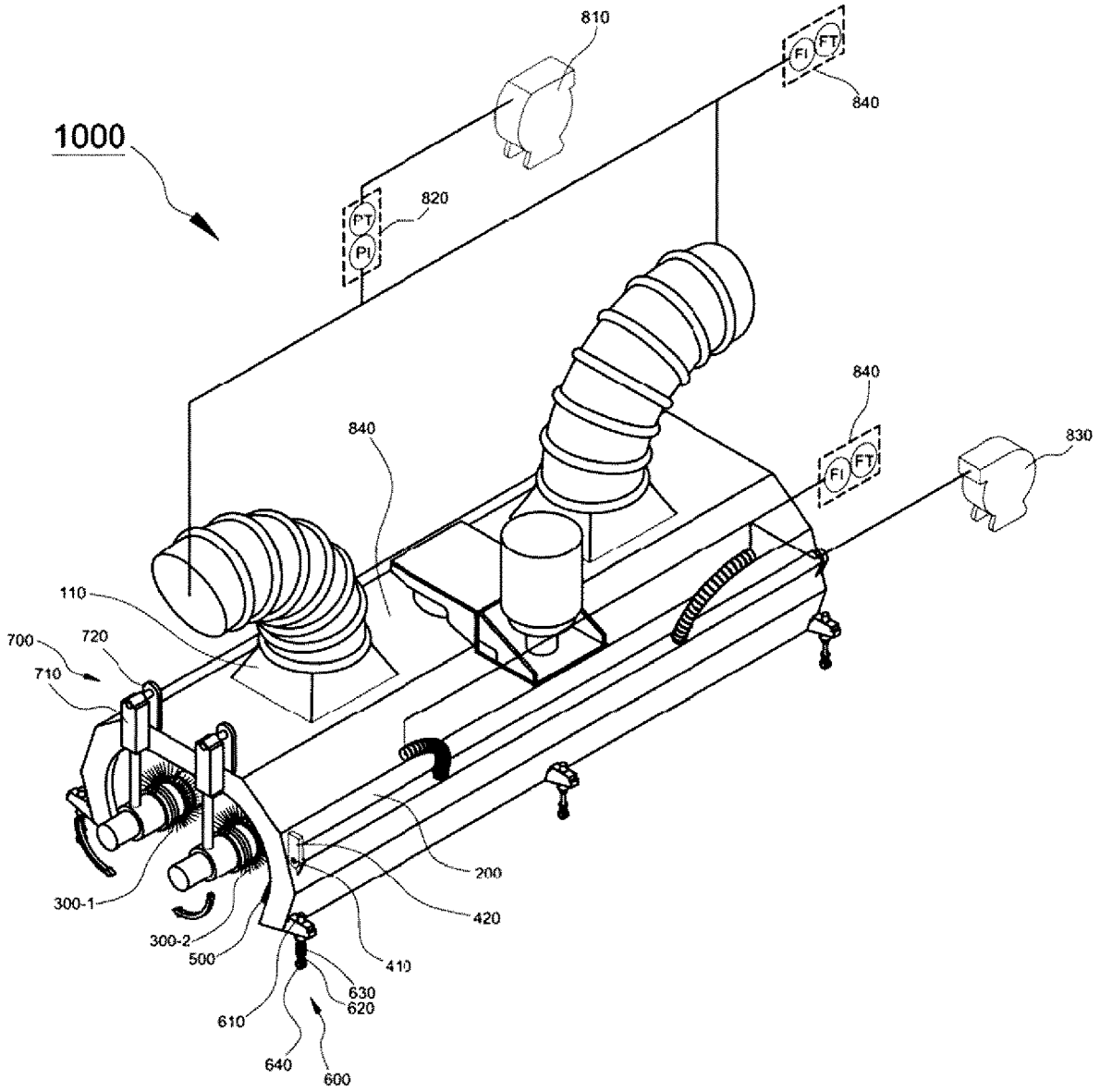
FIG. 3 is a front view showing a cleaning device having a hood equipped with a sweeper and an air knife according to Embodiment 2 of the present invention.
Figure 4:
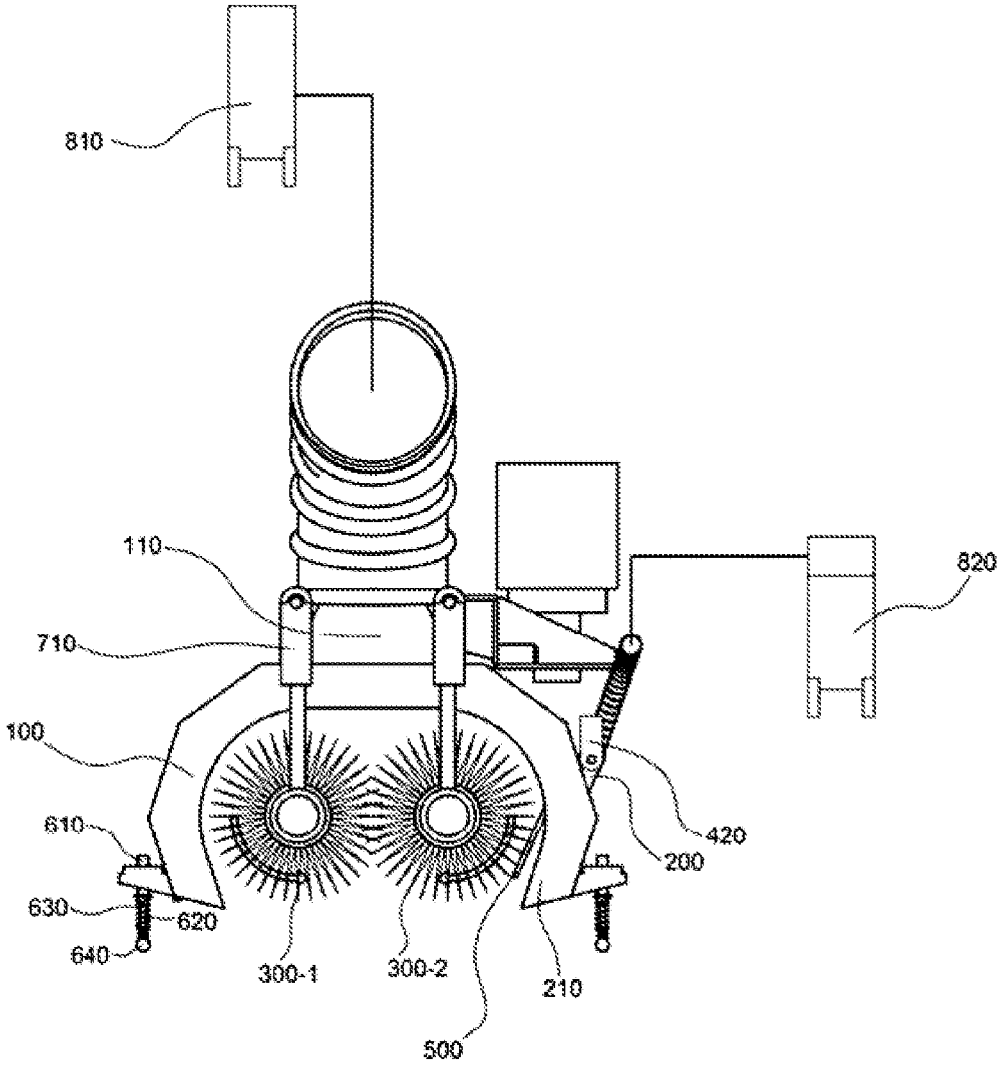
FIG. 4 is a front view showing a cleaning device having a hood equipped with a sweeper and an air knife according to Embodiment 2 of the present invention.

FIG. 3 is a front view showing a cleaning device having a hood with a sweeper and an air knife (1000) according to the embodiment 2 of the present invention, and FIG. 4 is a front view showing a cleaning device having a hood with a sweeper and an air knife (1000) according to the embodiment 2 of the present invention. As shown in FIGS. 3 and 4, a cleaning device having a hood with a sweeper and an air knife (1000) according to the embodiment 2 of the present invention includes a covering hood (100), a first sweeper (300-1), and a second sweeper (300-2). The covering hood (100), the main body of the present invention, may be formed in a hollow tube structure with a lower surface opened to face the surface to be cleaned, and has an inlet (110) through which contaminants are sucked. At this time, an intake inverter (810) for supplying a negative pressure to the inlet (110) and a pressure gauge (820) for measuring a negative pressure supplied to the inlet (110) from the intake inverter (810) may be further installed, and the pressure gauge (820) can be used to determine the negative pressure of the inlet (110) and to constantly adjust the pneumatic pressure to be supplied to the inlet (110) by the intake inverter (810). The first sweeper (300-1) is installed on the inner side of the covering hood (100) and rotated to guide foreign objects swept away from the surface to be cleaned to the inlet (110). Since the rotation of the first sweeper (300-1) is performed by a normal driving motor (not shown), which is a well-known technique, detailed description thereof will be omitted. The second sweeper (300-2) is installed on the other side of the covering hood (100) and rotated in a direction different from that of the first sweeper (300-1) to guide foreign objects swept from the surface to be cleaned to the inlet (110) together with the first sweeper (300-1). Since the rotation of the first sweeper (300-1) is performed by a normal driving motor (not shown), which is a well-known technique, detailed description thereof will be omitted. Conventional contaminant suction devices have had a problem that, depending on the surface roughness, contaminants could not be swept by a brush but remained on the surface to be cleaned, and particulate and liquid materials contained in the contaminants of the surface were not sucked but remained on the surface to be cleaned. A cleaning device having a hood with a sweeper and an air knife (1000) according to the embodiment 2 of the present invention, however, can remove contaminants of the surface to be cleaned irrespective of the surface roughness and can easily remove particulate and liquid materials contained in the contaminants of the surface to be cleaned because a first sweeper (300-1) and a second sweeper (300-2), rotating in different directions, simultaneously sweep the surface to be cleaned and guide the contaminants to the inlet (1000). In addition, the cleaning device having a hood with a sweeper and an air knife (1000) may further include an air knife (200), a rotary member (400), a protective plate (500), a buffer member (600), and a support member (700). The air knife (200) is installed on the circumferential surface of the covering hood (100) and has an outlet (210) for spraying high pressure air to the surface to be cleaned to float foreign objects on the surface. At this time, the outlet (210) may be formed in a horizontally long hole structure, but the present invention is not limited thereto. At this time, the air knife (200) may be further provided with a supply inverter (830) for supplying high-pressure air with its flow rate regulated and a flowmeter (840) for measuring the flow rate supplied to the air knife (200) from the supply inverter (830). The rotary member (400), which rotates the air knife (200) to adjust the position of the air knife (200) that injects high-pressure air, includes a shaft (410) passing through the circumference of the covering hood (100) and the air knife (200) and a rotary knob (420) coupled to one end of the shaft (410) to manually rotate the air knife (200) to adjust an air spray angle. The protective plate (500) is installed on the air knife (200) to face the first sweeper (300-1) and the second sweeper (300-2) so that contaminants floating on the surface to be cleaned are prevented from impacting against the air knife (200). At this time, the protective plate (500) is installed at a position where the protective plate (500) is in contact with the rotation radius of the first sweeper (300-1) and the second sweeper (300-2), so that the contaminants sticking to a surface facing the first sweeper (300-1) and the second sweeper (300-2) are swept away by the rotation of the first sweeper (300-1) and the second sweeper (300-2). The buffer member (600), which is to control the gap between the covering hood (100) and the surface to be cleaned, includes: a buffer socket (610) vertically and penetratingly coupled to a buffer pad extending on an outer circumferential surface of the covering hood (100) and having a lower surface opened; a buffer pin (620) inserted into the lower surface of the buffer socket 610); a buffer spring (630) having both ends connected to the outer circumferential surface of the buffer socket (610) and the outer circumferential surface of the buffer pin (620); and a buffer ball (640) coupled to the lower end of the buffer pin (620). The buffer ball (640), which is to adjust the elasticity of the buffer spring (630), adjusts the gap between the covering hood (100) and the surface to be cleaned so that the friction between the covering hood (100) and the surface to be cleaned can be minimized when the covering hood (100) is moving. The support member (700) includes: a support shaft (710) formed to be long in the vertical direction and hinged to the axis of the first sweeper (300-1) and the second sweeper (300-2) that are simply fitted to the covering hood (100) for an easy replacement of the first sweeper (300-1) and the second sweeper (300-2); and a support pin (720) coupled to the back of the support shaft (710) and fitted to an outer circumferential surface of the covering hood (100) at a lower surface thereof. Accordingly, it is possible to easily replace the first sweeper (300-1) and the second sweeper (300-2) by simply releasing the fitting between the support member (700) and the covering hood (100). It is to be understood that the present invention is not limited to the above-described embodiments and that various changes and modifications may be made without departing from the spirit and scope of the present invention as defined in the appended claims.

What is claimed is:

1. A cleaning device comprising:

a covering hood having a lower surface facing a surface to be cleaned and an inlet on an upper surface thereof, through which contaminants are sucked;

an air knife provided on a circumference of the covering hood and having an outlet for spraying high pressure air to the surface to be cleaned;

a sweeper installed inside the covering hood and configured to be rotated by a driving motor to guide foreign objects swept away from the surface to be cleaned and contaminants floated by the high pressure air injection of the air knife to the inlet;

a rotary member including a shaft passing through a circumferential surface of the covering hood and the air knife, and a rotary knob coupled to one end of the shaft to manually rotate the air knife to adjust an air spray angle; and a protective plate mounted on a surface of the air knife facing the sweeper to prevent the contaminants from impacting the air knife.

2. The cleaning device according to claim 1, further comprising a buffer member, wherein the buffer member comprises a buffer socket vertically penetratingly coupled to a buffer pad extending on the outer circumference of the covering hood and having a lower surface opened; a buffer pin inserted into a lower surface of the buffer socket; a buffer spring having opposite ends coupled respectively to an outer circumferential surface of the buffer socket and to an outer circumferential surface of the buffer pin; and a buffer ball coupled to a lower end of the buffer pin.

3. The cleaning device according to claim 1, further comprising a support member, wherein the support member comprises a support shaft hinged to an axis of the sweeper and extending in the vertical direction; and a support pin coupled to the back of the support shaft and fitted to the outer circumferential surface of the covering hood at a lower surface thereof.

4. A cleaning device comprising:

a covering hood having a lower surface opened facing a surface to be cleaned and an inlet on an upper surface thereof, through which contaminants are sucked;

a first sweeper installed at one side of an inside of the covering hood and configured to be rotated by a first driving motor to guide foreign objects swept from the surface to be cleaned to the inlet;

a second sweeper installed on an other side of the covering hood and configured to be rotated by a second driving motor in a direction different from that of the first sweeper to guide foreign objects swept from the surface to be cleaned to the inlet together with the first sweeper;

an air knife installed on a circumferential surface of the covering hood and having an outlet for spraying high pressure air to the surface to be cleaned;

a rotary member including a shaft passing through a circumferential surface of the covering hood and an air knife, and a rotary knob coupled to one end of the shaft to manually rotate the air knife to adjust an air spray angle; and a protective plate provided on a surface of the air knife, facing the first sweeper and the second sweeper, so that the contaminants are prevented from impacting against the air knife.

5. The cleaning device according to claim 4, further comprising a buffer member, wherein the buffer member includes a buffer socket vertically penetratingly coupled to a buffer pad extending on the outer circumference of the covering hood and having a lower surface opened; a buffer pin inserted into a lower surface of the buffer socket; a buffer spring having opposite ends coupled respectively to an outer circumferential surface of the buffer socket and to an outer circumferential surface of the buffer pin; and a buffer ball coupled to a lower end of the buffer pin.

6. The cleaning device according to claim 4, further comprising a support member, wherein the support member includes a pair of support shafts which are extended in the vertical direction and hinged to axes of the first and the second sweepers; and a pair of support pins which are respectively coupled to the rear of the pair of support shafts and fitted to the outer circumferential surface of the covering hood.

* * * * *